US005438798A

United States Patent [19]

Plamper et al.

[11] Patent Number: 5,438,798

[45] Date of Patent: Aug. 8, 1995

[54] SAFETY EDGE ASSEMBLY FOR A MOVABLE CLOSURE

[75] Inventors: Günter Plamper, Strongsville; Gerhard Plamper, Valley City, both of Ohio

[73] Assignee: Action Industries, Inc., Cleveland, Ohio

[21] Appl. No.: 94,362

[22] Filed: Jul. 19, 1993

[51] Int. Cl.[6] ..... E05F 15/02

[52] U.S. Cl. ..... 49/28; 200/61.43; 29/451

[58] Field of Search ..... 49/26, 27, 28, 506; 200/61.43; 29/700, 451

[56] References Cited

U.S. PATENT DOCUMENTS

| | | | |
|---|---|---|---|
| 3,118,984 | 4/1961 | Koenig | 200/61.43 |
| 3,277,256 | 10/1966 | Jones | 200/61.43 |
| 4,972,054 | 11/1990 | Miller et al. | 200/61.43 |
| 5,079,417 | 1/1992 | Strand | 250/221 |
| 5,087,799 | 2/1992 | Pariot et al. | 200/61.43 |
| 5,124,511 | 6/1992 | Miller et al. | 200/61.43 |
| 5,157,230 | 10/1992 | Blubaugh | 200/61.43 |
| 5,260,529 | 11/1993 | Miller | 200/61.43 |

FOREIGN PATENT DOCUMENTS

| | | | |
|---|---|---|---|
| 2643505 | 3/1978 | Germany | 200/61.43 |

OTHER PUBLICATIONS

Advertisement of Tapeswitch Corporation showing sensing edges, dated prior to the invention herein.

*Primary Examiner*—Jerry Redman
*Attorney, Agent, or Firm*—Tarolli, Sundheim & Covell

[57] ABSTRACT

A safety edge assembly, for a movable closure such as a garage door, automatically reverses the direction of travel of the door when the door encounters an obstruction. The safety edge assembly includes an electrically conductive mounting rail fixed to the door, and a deformable tubular member supported on the mounting rail. A conductive member on the tubular member is movable, upon deformation of the tubular member, from a first position normally spaced from the conductive mounting rail into a second position in engagement with the conductive mounting rail to complete an electrical circuit for controlling the direction of movement of the door. An end plug for closing the open end of the tubular member has a nonconductive portion for insertion between the end of the conductive member, which may fray or otherwise move out of position while being cut to length in the field, and the end of the conductive mounting rail to provide electrical insulation therebetween. A method of controlling operation of a movable door includes the step of moving an electrically conductive member on a deformable member on a leading edge of the door into electrical contact with an electrically conductive mounting rail on the leading edge of the door, under the influence of forces applied to the deformable member by contact of the tubular member with an obstruction, to control actuation of the movable door.

19 Claims, 6 Drawing Sheets

SAFETY EDGE ASSEMBLY FOR A MOVABLE CLOSURE

BACKGROUND OF THE INVENTION

The present invention relates to a safety edge assembly for a movable closure. More particularly, the present invention relates to a safety edge assembly for automatically reversing the direction of travel of a garage door when the door encounters an obstruction.

DESCRIPTION OF THE PRIOR ART

Movable closures, such as garage doors, should be capable of reversing direction upon encountering an obstruction when the door is closing. To this end, it is known to provide a safety edge assembly for mounting on a leading edge portion of an electrically operated garage door. Should the leading edge portion of the garage door encounter an obstruction such as a person or object, in the path of travel of the closing door, the safety edge assembly actuates the electric door operator to reverse the direction of travel of the door. Typical safety edge assemblies are disclosed in U.S. Pat. Nos. 3,315,050 and 5,087,799. These patents disclose safety edge assemblies using conductive aluminum foil sheets surrounded by a flexible foam strip jacket or other sealed plastic covers.

SUMMARY OF THE INVENTION

The present invention is a safety edge assembly for mounting on a leading edge of a door, such as an overhead garage door, which door is movable by an electrically controlled operator in a first direction to close the door and in a second direction opposite to the first direction to open the door. The safety edge assembly includes an electrically conductive mounting rail for connection with the door. A deformable tubular member is supported on the mounting rail. A conductive member on the tubular member is movable, upon deformation of the tubular member, from a first position normally spaced from the conductive mounting rail into a second position in engagement with the conductive mounting rail to complete an electrical circuit for controlling the direction of movement of the door.

An end plug is provided for closing the open end of the tubular member. The end plug has a nonconductive portion for insertion between the end of the conductive member on the tubular member and the end of the conductive mounting rail to provide electrical insulation therebetween. Thus, if the end of the conductive member frays or otherwise moves out of position, for example, while being cut to length in the field, the end of the conductive member will not inadvertently contact the conductive mounting rail.

The present invention is also a method of controlling operation of a movable door including the step of moving an electrically conductive member on a deformable member on a leading edge of the door into electrical contact with an electrically conductive mounting rail on the leading edge of the door, under the influence of forces applied to the deformable member as a result of contact of the deformable member with an obstruction, to control actuation of the movable door.

The present invention is also a method of mounting a safety edge assembly on a leading edge of a door such as an overhead garage door. The method includes the steps of providing a conductive mounting rail, making it a desired length corresponding to the length of the door, and attaching the conductive mounting rail to the leading edge of the door; providing a tubular member having a conductive portion, making it a desired length corresponding to the length of the door, and mounting it on the conductive mounting rail with its conductive portion spaced apart from the conductive mounting rail; and inserting an electrically insulating portion of an end plug into one end of the tube between the conductive rail and the conductive portion of the tube to provide electrical insulation therebetween.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

The present invention relates to a safety edge assembly for mounting on the leading edge of an electrically operated closure, which closure is movable by an electrically controlled operator in a first direction to close the closure and in a second direction opposite to the first direction to open the closure. The safety edge assembly is responsive to engagement with an object to actuate the operator to reverse the direction of travel of the closure.

Figures 1, 2:
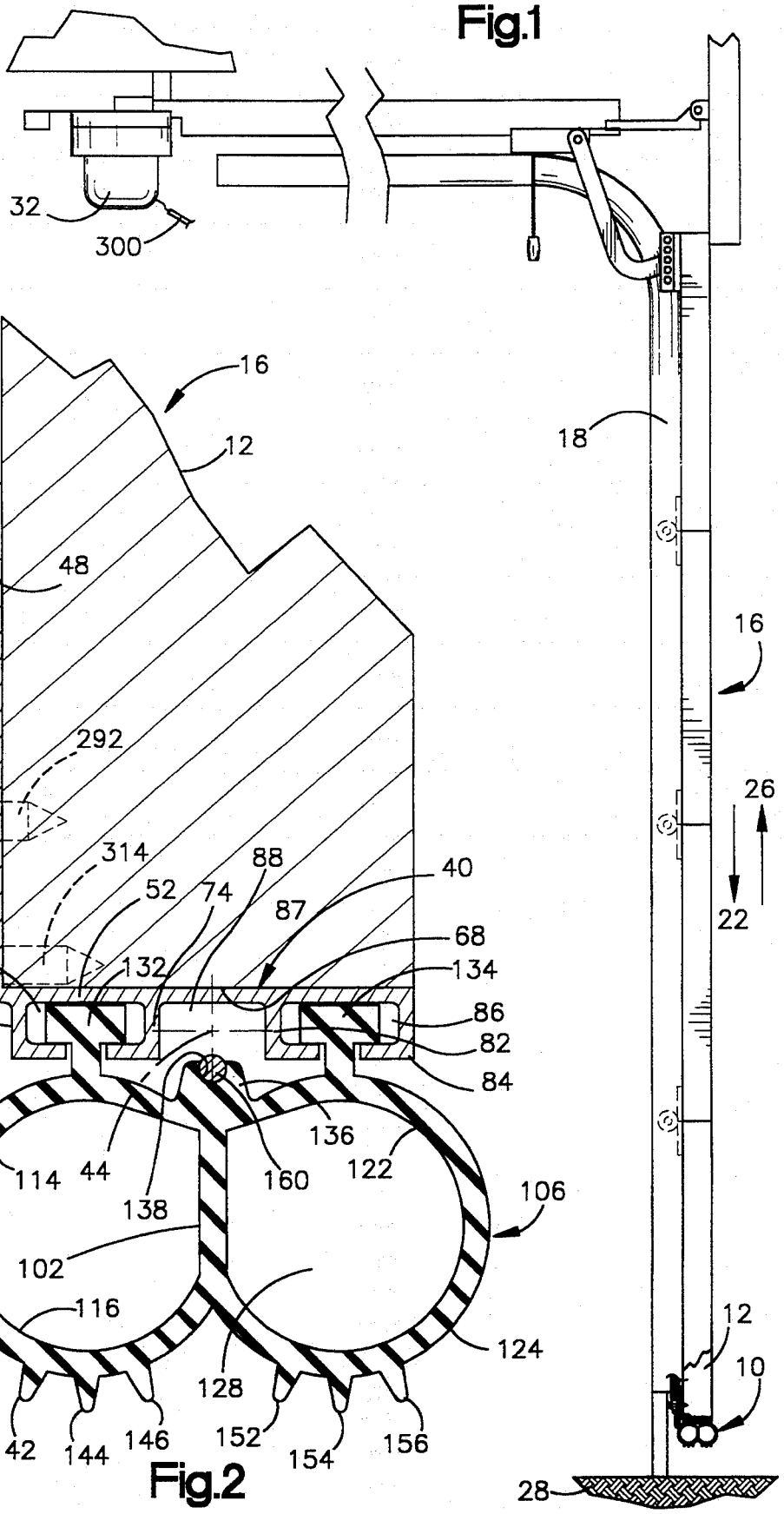
FIG. 1 is a pictorial view, partially broken away, of an electrically operated overhead garage door assembly incorporating a safety edge assembly in accordance with the present invention.
FIG. 2 is a view partially in section of the safety edge assembly of FIG. 1, in an unactuated condition.

The present invention is applicable to various electrically controlled closures. As representative of the present invention, FIG. 1 illustrates a safety edge assembly 10 on the leading edge 12 of an overhead garage door 16. The safety edge assembly 10 extends the length of the door 16 (from left to right as viewed in FIG. 4). The door 16 is movable on a track 18 in a first direction to close the door, as indicated by the arrow 22. The door 16 is movable on the track 18 in a second direction to open the door, as indicated by the arrow 26. When the door 16 is closed, the safety edge assembly 10 abuts against a floor 28 and seals the interior of the closure from the environment.

The opening and closing of the door 16 is controlled by an electrically controlled operator 32. The electrically controlled operator 32 is responsive to electric signals in a known manner to move the door 16 along the track 18 to its open or closed position. The safety edge assembly 10 may alternatively be used in conjunction with other types of electrically controlled closures, such as other vertically or horizontally movable doors. In the specification and claims herein, the term "door" is used to refer to any type of movable member with which a safety edge assembly in accordance with the present invention may be used.

The safety edge assembly 10 includes an electrically conductive mounting rail 40 (FIGS. 1–4). The mounting rail 40 is made from a non-corroding electrically conductive material, preferably aluminum. The mounting rail 40 extends the length of the safety edge assembly 10 (from left to right as viewed in FIG. 4) along an axis 44 (FIG. 2). The mounting rail 40 is fixedly attached in a suitable manner, as by a plurality of screws (not shown) to the leading edge portion 12 of the door 16.

The mounting rail 40 is relatively rigid and is generally L-shaped in cross-sectional configuration and includes a vertically extending portion 48 and a horizontally extending portion 52. (The terms "vertical" and "horizontal" are used herein to describe the rail portions 48 and 52, respectively, when the mounting rail 40 is oriented as shown in the FIGS. It should be understood that, when the safety edge assembly 10 is oriented differently, the rail portions 48 and 52 will not be in the vertical and horizontal orientations shown).

The vertically extending rail portion 48 is in abutting engagement with a side surface 54 of the door 16. Three screw holes 62, 64 and 66 (FIG. 3) extend through the vertically extending rail portion 48.

The horizontally extending rail portion 52 is in abutting engagement with a leading edge surface 68 (FIG. 12) of the door 16. The horizontally extending rail portion 52 has a first pair of downwardly depending channel members 72 and 74 defining between them a first support channel 78. The horizontally extending portion 52 has a second pair of downwardly depending channel members 82 and 84 defining between them a second support channel 86. The support channels 84 and 86 extend the length of the mounting rail 40 (from left to right as viewed in FIG. 4) parallel to the axis 44.

The channel members 74 and 82, together with a central portion 87 of the horizontally extending rail portion 52, form three sides of and partially define between them a central channel 88 of the safety edge assembly 10. The central channel 88 is generally rectangular in cross-sectional configuration. The central channel 88 extends the length of the mounting rail (from left to right as viewed in FIG. 4) parallel to the axis 44.

An opening 92 (FIG. 3) extends through the horizontally extending rail portion 52 and into the central channel 88. The opening 92 is spaced inwardly from the right end of the mounting rail 40 as viewed in FIG. 4.

The safety edge assembly 10 includes a tubular member 100 which extends the length of the safety edge assembly 10 (from left to right as viewed in FIG. 4) parallel to the axis 44. The tubular member 100 is an easily deformable, weather proof, tear resistant member which seals between the floor 28 and the leading edge 14 of the door 16 when the door is in a closed position. The tubular member 100 is preferably made from SBR rubber, Shore 70±2. The tubular member may alternatively be made from a suitable material such as rubber, vinyl, butadiene and the like.

The tubular member 100 (FIG. 2) has a central wall 102, a first arcuate wall 104 and a second arcuate wall 106. The central wall 102 extends in a plane parallel to the axis 44 and is disposed below the axis 44 as viewed in FIG. 2. The first arcuate wall 104 has an upper portion 114 and a lower portion 116. The first arcuate wall 104 and the central wall 102 define a tubular first chamber 118. The second arcuate wall 106 has an upper portion 122 and a lower portion 124. The second arcuate wall 106 and the central wall 102 define a second tubular chamber 128.

The first chamber 118 and the second chamber 128 extend parallel to each other along the length of the safety edge assembly 10 (from left to right as viewed in FIG. 4) parallel to the axis 44. The tubular member 100 thus has a cross-sectional configuration similar to, for example, that of a double-barrelled shotgun.

The tubular member 100 includes a T-shaped first support member 132 which extends upwardly from the upper portion 114 of the first arcuate wall 104. The first support member 132 is received in the first channel 78 of the mounting rail 40 and supports the tubular member 100 on the mounting rail 40. The tubular member 100 includes a T-shaped second support member 134 which extends upwardly from the upper portion 122 of the second arcuate wall 106. The second support member 134 is received in the second channel 86 of the mounting rail 40 and supports the tubular member 100 on the mounting rail 40.

The tubular member 100 has an upper channel portion 136. The upper channel portion 136 is disposed above the central wall 102 and defines an upper channel 138 in the tubular member 100. The upper channel 138 extends as a rib along the length of the tubular member 100 and is parallel to the axis 44 of the safety edge assembly 10. The upper channel portion 136 is partially cut back to form an axial end surface 140 facing the right hand end of the tubular member 100 as viewed in FIG. 3.

The tubular member 100 includes a plurality of ribs 142, 144 and 146 extending downwardly from the lower portion 116 of the first arcuate wall 104. A plurality of ribs 152, 154 and 156 extend downwardly from the lower portion 124 of the second arcuate wall 106.

The safety edge assembly 10 includes an electrically conductive member 160 (FIGS. 1–4) secured in the upper channel 138 of the tubular member 100. The electrically conductive member 160 is a relatively flexible piece made from a non-corroding material and is preferably a 1×19 stainless steel wire. The member 160 may also be a metal foil or other metal strip, or an electrically conductive plastic strip. The electrically conductive member 160 is preferably co-extruded with the tubular member 100. The electrically conductive member 160 may alternatively be secured in the upper channel 138 by a suitable adhesive.

The electrically conductive member 160 extends the length of the safety edge assembly 10. The electrically conductive member 160 in a non-actuated condition is normally spaced a small distance from the conductive mounting rail 40 with the central channel 88 between the electrically conductive member and the mounting rail, as illustrated in FIG. 2. The electrically conductive member 160 is disposed along the open fourth side of the central channel 88.

The safety edge assembly 10 includes an end plug 170 (FIGS. 3–4 and 6–8) for sealing the right hand end (as viewed in FIG. 4) of the tubular member 100. The end plug 170 has a pair of hollow tubular inserts 174 and 176 and an end cap 178. The first tubular insert 174 projects axially inwardly from the end cap 178 into the first chamber 118 of the tubular member 100. The first tubular insert 174 fits snugly in the first chamber 118 to seal the first chamber 118. The second tubular insert 176 projects axially inwardly from the end cap 178 into the second chamber 128 of the tubular member 100. The second tubular insert 176 fits snugly in the second chamber 128 to seal the second chamber 128.

The end cap 178 has a tab 184 which extends axially inwardly for a short distance into the central channel 88 of the mounting rail 40. The tab 184 is disposed in the central channel 88 between the end of the mounting rail 40 and the end of the electrically conductive member 160. The tab 184 electrically insulates between the end of the electrically conductive mounting rail 40 and the end of the electrically conductive member 160. The tab 184 has a retainer button 186 which fits into the opening 92 of the horizontally extending rail portion 52 to secure the end plug 170 to the mounting rail 40.

Figure 7:
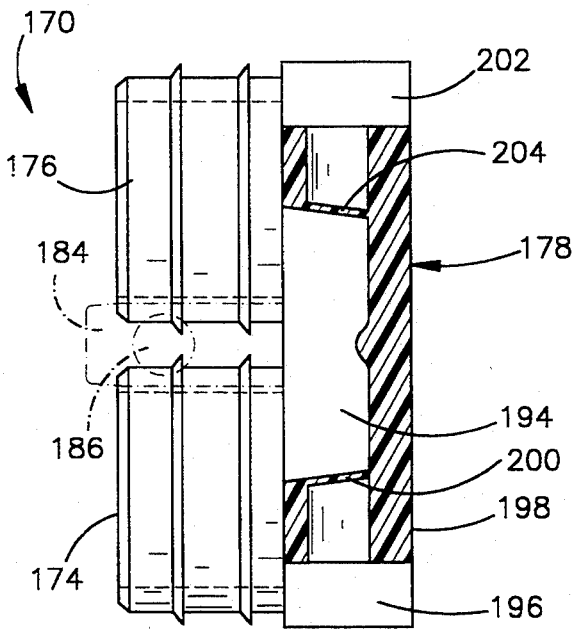
FIG. 7 is a sectional view of the end plug of FIG. 6, taken generally along line 7—7 of FIG. 6.
Figure 6:
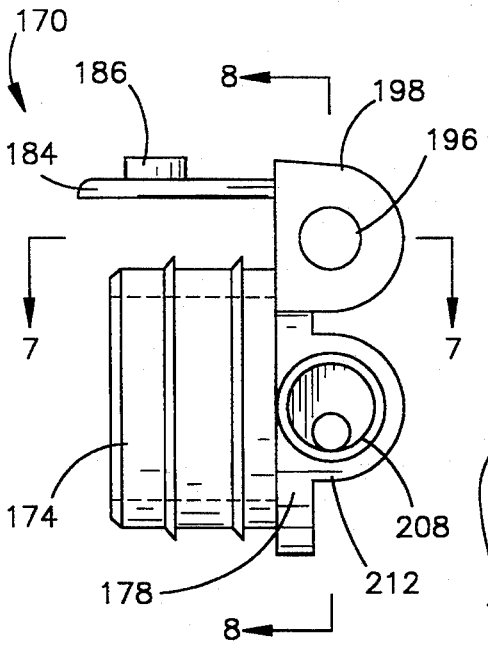
FIG. 6 is an elevational view of an end plug of the safety edge assembly of FIG. 1.
Figure 8:
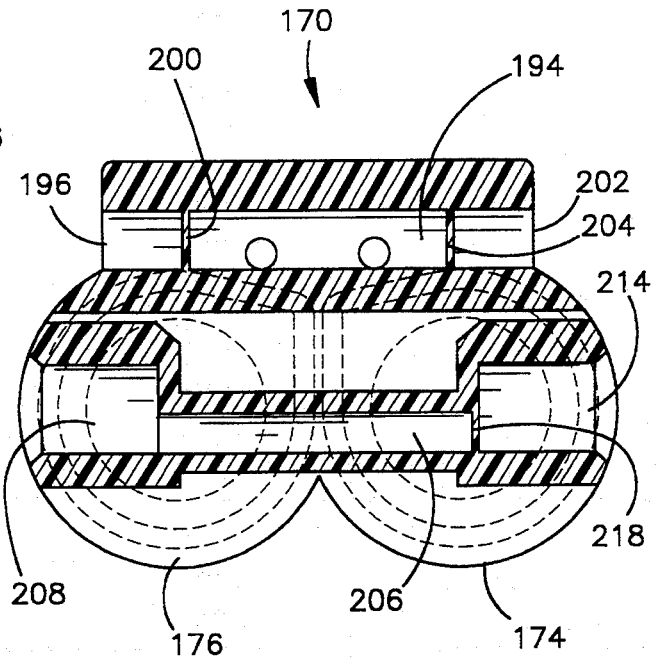
FIG. 8 is another sectional view of the end plug of FIG. 6, taken generally along line 8—8 of FIG. 6.

The end plug 170 includes an electrical connector passage 194 in an upper portion 198 of the end plug 170 (FIG. 7). The electrical connector passage 194 extends between passage openings 196 and 202 on opposite sides of the end plug 170. The electrical connector passage 194 opens into the central channel 88 below the tab 184 when the end plug 170 is connected with the mounting rail 40.

The end plug 170 is preferably molded from PVC plastic. The end plug 170 when formed includes a pair of removable interior walls 200 and 204 in the electrical connector passage 194. The wall 200 blocks the passage 194 between the passage opening 196 and the central channel 88. The wall 204 blocks the passage 194 between the passage opening 202 and the central channel 88.

Figure 4:
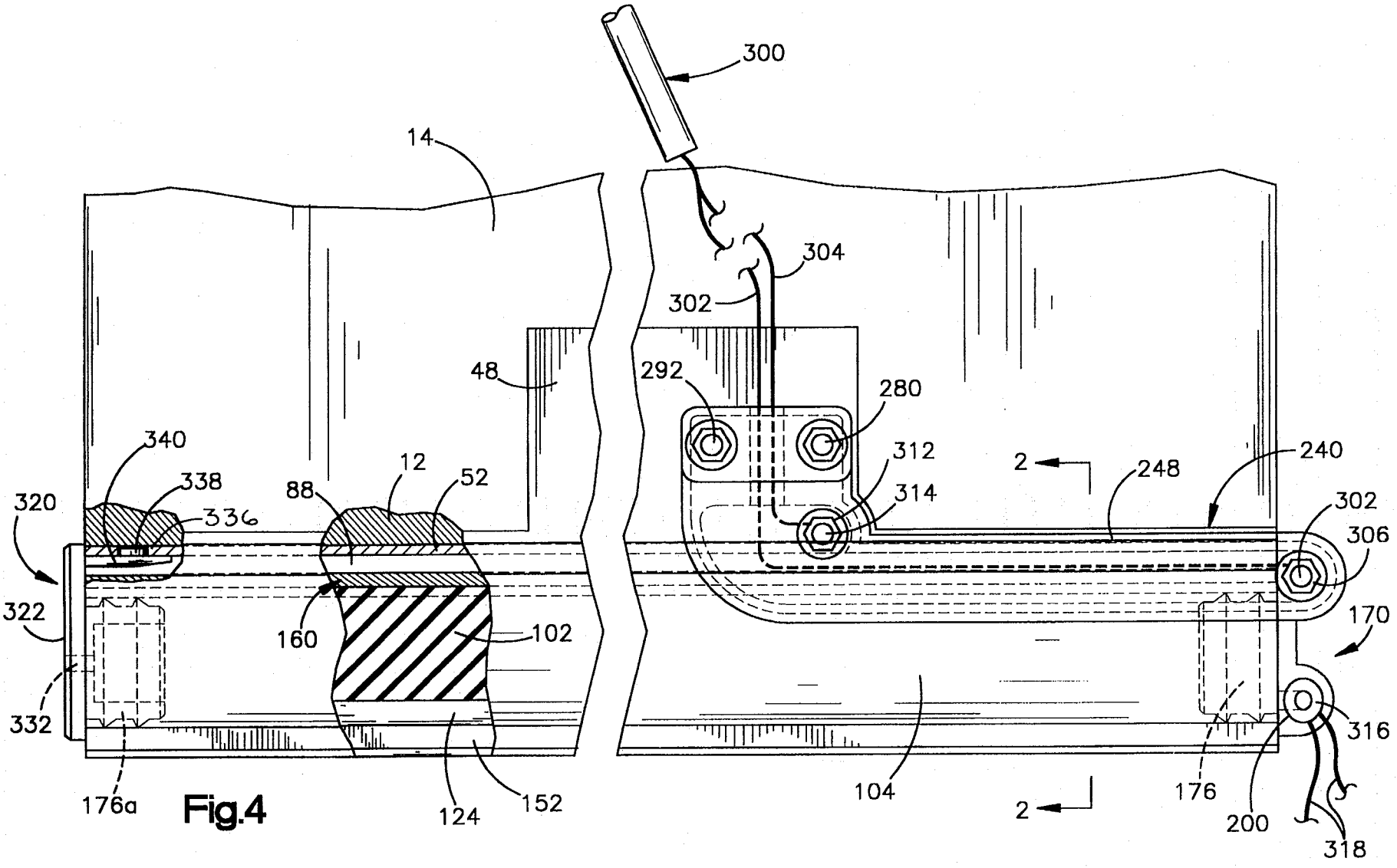
FIG. 4 is an elevational view partially broken away of the safety edge assembly of FIG. 1, taken generally along line 4—4 of FIG. 2 and showing portions cut away in section.

In the end plug 170 disposed at the right hand end of the safety edge assembly 10 as viewed in FIG. 4, the interior wall 200 in the electrical connector passage 194 is removed. Thus, the electrical connector passage 194 is open only between the central channel 88 and the opening 196.

The end plug 170 includes an air pressure passage 206 in a lower portion 212 of the end plug 170. The air pressure passage 206 extends between passage openings 208 and 214 on opposite sides of the end plug 170. The air pressure passage 206 extends between the interiors of the tubular inserts 174 and 176. The air pressure passage 206 is thus in fluid communication with the chambers 118 and 128 of the tubular member 100.

When the end plug 170 is formed it includes a pair of removable interior walls 216 and 218 in the air pressure passage 206. The wall 216 blocks the air pressure passage 206 between the passage opening 208 and the interior of the tubular inserts 174 and 176. The wall 218 blocks the air pressure passage 206 between the passage opening 214 and the tubular inserts 174 and 176.

In the end plug 170 disposed at the right hand end of the safety edge assembly 10, as viewed in FIG. 4, the interior wall 216 in the air pressure passage 206 is removed. Thus, the air pressure passage 206 is open only between the tubular inserts 174 and 176 and the opening 208.

Figure 3:
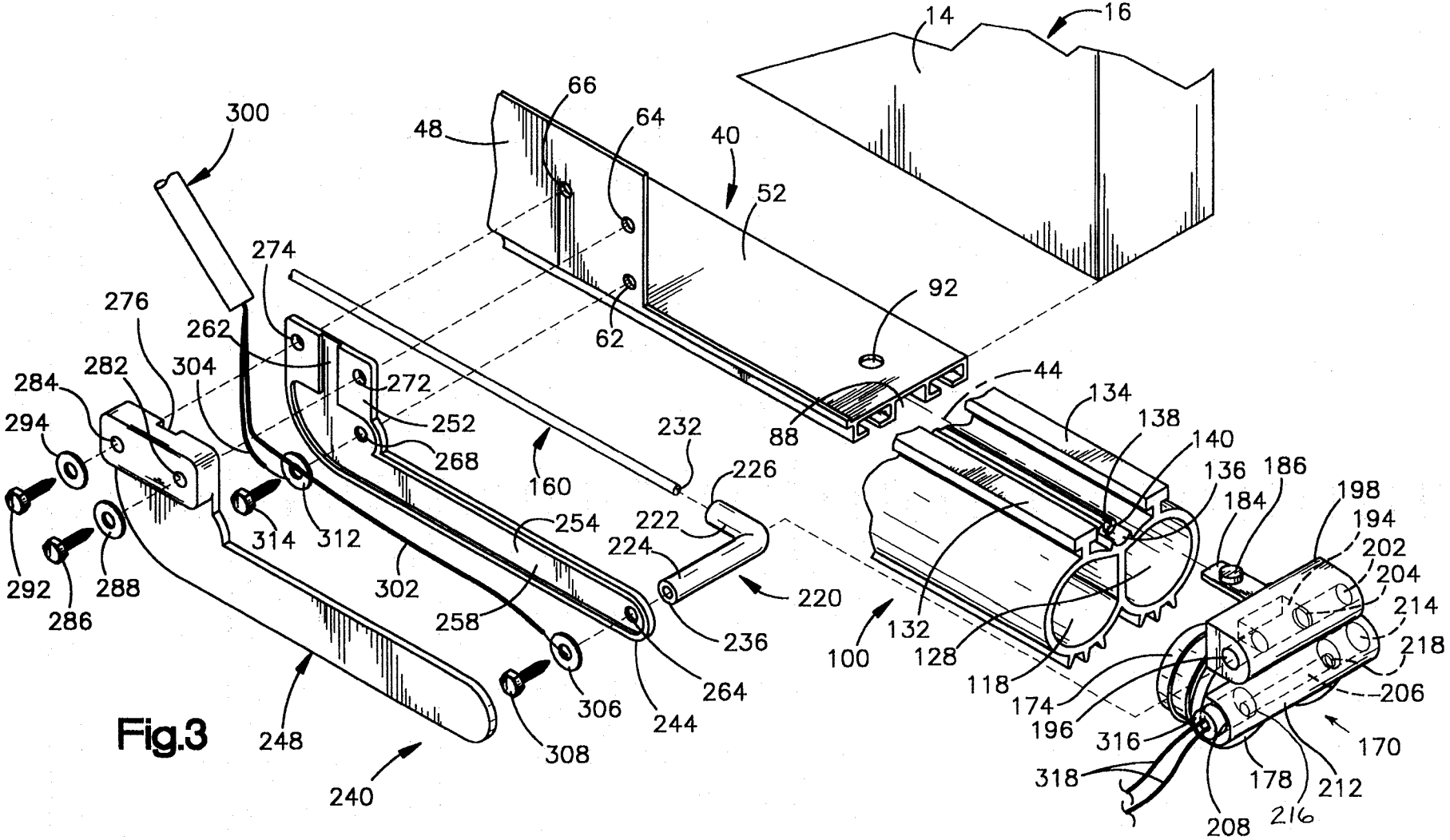
FIG. 3 is an exploded perspective view of the safety edge assembly of FIG. 1.

The safety edge assembly 10 includes an electrical connector 220 (FIG. 3) disposed at least partially in the electrical connector passage 194. The electrical connector 220 is tubular and generally L-shaped as shown in FIG. 3. The electrical connector 220 is made from a non-corroding electrically conductive material, such as brass, bronze, and the like.

The electrical connector 220 has a first leg 222 and a second leg 224. The first leg 222 extends parallel to the axis 44 and engages the axial end surface 140 of the upper channel portion 136 of the tubular member 100. The first leg 222 has an end portion 226 which receives an end portion 232 of the electrically conductive member 160 disposed in the upper channel 138. Thus, electrical contact is established between the electrically conductive member 160 and the electrical connector 220.

The second leg 224 of the electrical connector 220 extends perpendicular to the first leg 222. The second leg 224 extends through the electrical connector passage 194 in the upper portion 198 of the end plug 170. The second leg 224 has an end portion 236 exposed at the electrical connector opening 196 of the end cap 178.

The end plug 170 is thus used to electrically connect the operator 32 and the electrically conductive member 160. Because the end plug 170 has openings on both sides into the electrical connector passage 194, the end plug can also be used at the left end of the safety edge assembly 10 if the electrical connection is made at the left end of the safety edge assembly. The installer simply removes the appropriate interior wall in the passage 194 as needed for the one end plug 170 which will carry the electrical connector 220. Alternatively, the installer can make the electrical connection at the right hand end but on the opposite (back) side of the end plug 170, by removing the appropriate interior wall in the passage 194.

A known air pressure switch 316 is disposed in the air pressure passage 206 in the lower portion 212 of the end plug 170. A pair of lead wires 318 extend from the air pressure switch 316 and are electrically connected in a known manner (not shown) to the electrically controlled operator 32.

Alternatively, other known structures for sensing changes in pressure in the first chamber 118 and in the second chamber 128 may be connected with or disposed in the air pressure passage 206. For example, an air hose may have one end plugged into the air pressure passage opening 208 and its other end connected with an externally mounted, known air pressure switch.

The end plug 170 is thus used to establish fluid communication between the interiors of the tubular chambers 118 and 128 and the air pressure sensing mechanism. Because the end plug 170 has openings on both sides into both the passage 206, the end plug can also be used at the left end of the safety edge assembly 10 if the connection is made at the left end of the safety edge assembly. The installer simply removes the appropriate interior wall(s) in the passage 206 as needed for the one end plug 170 which will connect with the air pressure sensing device. Alternatively, the installer can make the air pressure connection at the right hand end but on the opposite (back) side of the end plug 170, by removing the appropriate interior wall in the passage 206.

The safety edge assembly 10 includes a cover assembly 240 (FIG. 3). The cover assembly 240 includes an inner cover plate 244 and an outer cover plate 248.

The inner cover plate 244 has a vertically extending portion 252 in abutting engagement with the vertically extending portion 48 of the mounting rail 40. The inner cover plate 244 has an axially extending portion 254 extending along and in abutting engagement with the horizontally extending portion 52 of the mounting rail 40. The inner cover plate 244 has an inner surface 258 defining a wiring channel 262. A positive screw opening 264 extends through the axially extending portion 254 of the inner cover plate 244. A ground screw opening 268 extends through the vertically extending portion 252 of the inner cover plate 244. The inner cover plate portion 252 also has two mounting screw holes 272 and 274 located above the ground screw opening 268.

The outer cover plate 248 is substantially the same overall shape as the inner cover plate 244. The outer cover plate 248 snaps over the inner cover plate 244 to form the cover assembly 240. The outer cover plate 248 has a clamping edge surface 276 facing the vertically extending portion 48 of the mounting rail 40.

Two mounting screw holes 282 and 284 extend through the outer cover plate 248 and align with the mounting screw holes 272 and 274, respectively, in the inner cover plate. A mounting screw 286 extends through a washer 288, through the cover plate mounting screw holes 282 and 272 and the screw hole 64 of the mounting rail 40 into the door 16. A mounting screw 292 extends through washer 294, through the cover plate mounting screw holes 284 and 274 and the screw hole 66 of the mounting rail 40 into the door 16. The mounting screws 286 and 292 thus secure the cover assembly 240 to the mounting rail 40 and to the door 16.

A wiring harness 300 establishes electrical connection between the safety edge assembly 10 and the electrically controlled operator 32. The wiring harness 300 includes a positive wire 302 and a ground wire 304.

The positive wire 302 is connected to a positive washer 306. A metal self-tapping positive screw 308 extends through the positive washer 306 and through the positive screw opening 264 of the inner cover plate 244. The positive screw 308 is threaded into the end portion 236 of the second leg 222 of the electrical connector 220. Thus, electrical connection is established, through the electrical connector 220, between the positive wire 302 and the electrically conductive member 160.

The ground wire 304 of the wiring harness 300 is connected to a ground washer 312. A metal self-tapping ground screw 314 extends through the ground washer 312 and through the ground screw opening 268 of the inner cover plate 244. The ground screw 314 is threaded into the opening 62 of the vertically extending portion 48 of the mounting rail 40. Thus, electrical connection is established between the ground wire 304 and the mounting rail 40.

The positive wire 302 and the ground wire 304 extend along the wiring channel 262 of the inner cover plate 244. The positive wire 302 and the ground wire 304 as part of the wiring harness 300 extend upwardly out of the cover assembly 240 to the electrically controlled operator 32. The clamping edge surface 276 of the outer cover plate 248 clamps the wiring harness 300 against the inner cover plate 244 of the cover assembly 240. The lead wires 318 of the air pressure sensing switch 316 may also be included in the wiring harness 300.

The safety edge assembly 10 includes a second end plug 320 disposed at the other end of the safety edge assembly (the left end as viewed in FIG. 4). The second end plug 320 seals the left end of the safety edge assembly 10 from the environment. The second end plug 320 is somewhat similar to the end plug 170. However, since the electrical and air pressure connections to the safety edge assembly 10 are made through the end plug 170, the end plug 320 does not have portions for making these connections. Thus, the end plug 320 has an end cap 322, a tubular insert **176*a* (FIG. 4) for sealing the left end of the chamber 128, and a second tubular insert (not shown) for sealing the left end of the chamber 118. The end cap 322 seals the left end of the central channel 88. The end plug 320 is symmetrical and thus can be used at either end of the safety edge assembly 10**.

The mounting rail 40 has a retainer opening 336 (FIG. 4) extending through the horizontally extending rail portion 52 to the central channel 88. The retainer opening 336 is spaced inwardly from the left end portion of the mounting rail 40 as viewed in FIG. 4. The retainer opening 336 receives a retainer button 338 on a tab portion 340 of the end plug 320.

The end plug 320 may have a vent opening 332 extending axially through the end cap 178. The vent opening 332 normally is in a closed condition. The vent opening 332 opens when the pressure in the chambers 118 and 128 increases to a predetermined amount, to slowly release air from the first chamber 118 and the second chamber 128 of the tubular member 100 to the atmosphere. The vent opening 332 closes again upon the release of pressure from the chambers 118 and 128. The provision of a vent opening 332 can increase the shock cushioning effect of the tubular member 100.

When the door 16 (FIG. 1) is moved by the operator 32 in a closing direction as indicated by the arrow 22, and the safety edge assembly 10 is not in contact with an obstruction, the safety edge assembly 10 is in an unactuated condition as shown in FIG. 2. The electrically conductive member 160 secured to the tubular member 100 is spaced apart from the electrically conductive mounting rail 40, across the central channel 88. There is no electrical contact between the electrically conductive member 160 and the electrically conductive mounting rail 40. Thus, there is no closed electrical circuit between the positive wire 302 and the ground wire 304.

Figure 5:
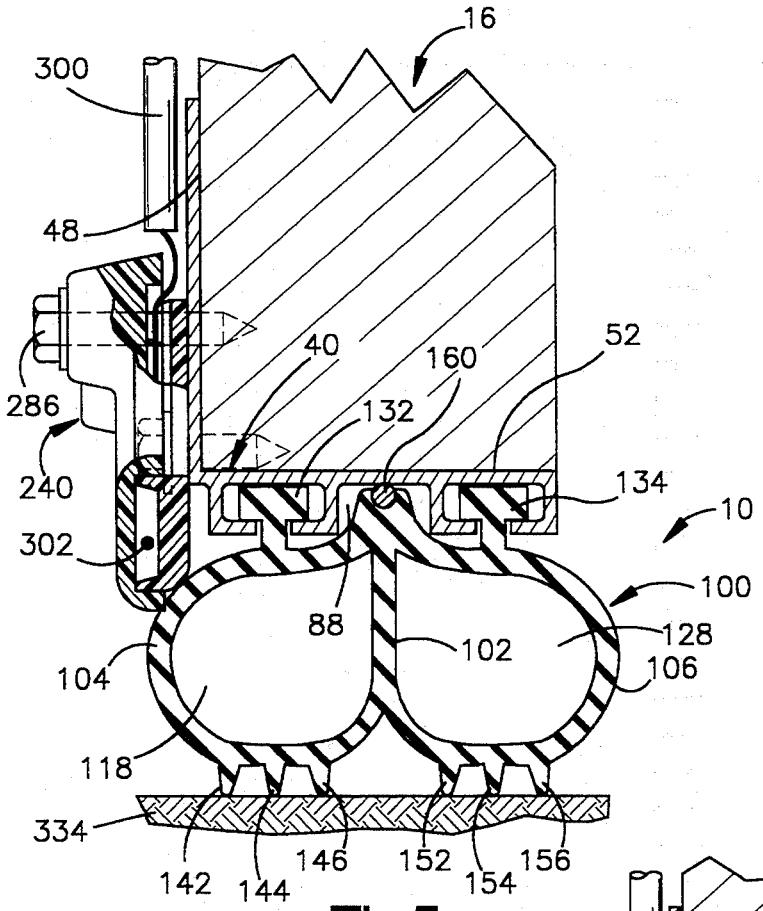
FIG. 5 is a view similar to FIG. 2 showing the safety edge assembly in an actuated condition.

Should the safety edge assembly 10 contact an obstruction 334 (FIG. 5) while the door 16 is closing, the safety edge assembly 10 is moved to an actuated condition as shown in FIG. 5. Specifically, the contact between the obstruction 334 and any of the ribs 142, 144, 146, 152, 154, 156 of the tubular member 100 deforms the tubular member 100 upwardly. The upper channel portion 136 of the tubular member 100 moves upwardly through the central channel 88 toward the electrically conductive mounting rail 40, from the position shown in FIG. 2 to the position shown in FIG. 5. Upward movement of the upper channel portion 136 of the tubular member 100 effects upward movement of the electrically conductive member 160 through the central channel 88, into engagement with the electrically conductive mounting rail 40. Depending on the direction of the force of engagement with the obstruction 334, the electrically conductive member 160 may move through the channel 88 in a first direction to engage the rail portion 87, in a second direction to engage the channel member 74, or in a third direction to engage the channel member 82.

The engagement of the electrically conductive member 160 with the mounting rail 40 establishes electrical contact and completes an electric circuit between the ground wire 304 and the positive wire 302. Specifically, an electric circuit is established between the ground wire 304; the ground screw 314; the mounting rail 40; the electrically conductive member 160; the electrical connector 220; the positive screw 308; and the positive wire 302. The completion of this electric circuit actuates the operator 32 to reverse the direction of the door 16.

Optionally, the air pressure switch 316 may also be actuated when the safety edge assembly 10 contacts the obstruction. The contact between the obstruction and the ribs 142, 144, 146, 152, 154 and 156 of the tubular member 100 deforms the tubular member. As the tubular member 100 deforms, it flattens slightly, as can be seen by a comparison between FIGS. 2 and 5. As the tubular member 100 flattens, the volume of the chambers 118 and 128 decreases. Because the chambers 118 and 128 are sealed by the end plugs 170 and 320, the pressure in the chambers 118 and 128 increases. The increase in pressure is sensed by the air pressure switch 316. The air pressure switch 316 outputs a signal along the lead wires 318 to actuate the operator 32 and reverse the direction of travel of the door 16.

Actuation of the safety edge assembly 10 may be disabled in a known manner, as by an end-of-travel switch, when the tubular member 100 reaches a position within about one inch of the floor 28.

Figure 9:
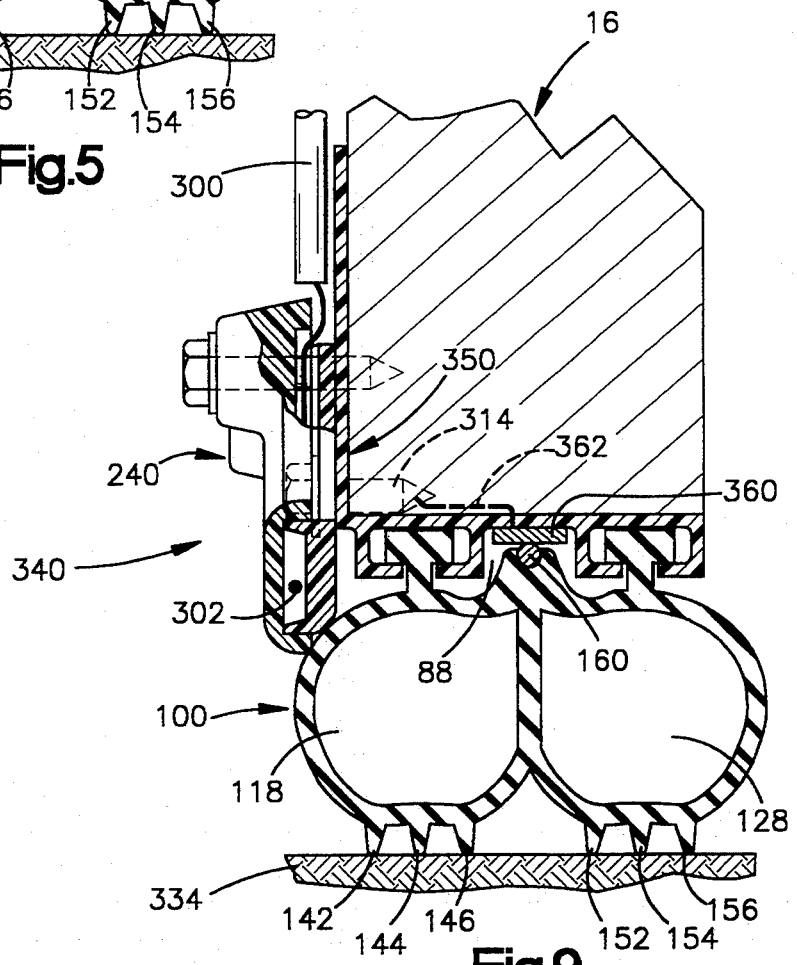
FIG. 9 is a view similar to FIG. 2 illustrating a second embodiment of the invention in which the mounting rail is nonconductive and shown in an actuated condition.

A safety edge assembly 340 in accordance with a second embodiment of the invention is illustrated in FIG. 9. Most parts of the safety edge assembly 340 are the same as the parts of the safety edge assembly 10 (FIGS. 1–8) and thus are given the same reference numerals. The difference is that the safety edge assembly 340 includes a mounting rail 350 which is made from a nonconductive material, preferably plastic. A separate conductive rail member 360 is disposed on a lower surface of the mounting rail 350.

The conductive rail member 360 extends the length of the mounting rail 350 in the central channel 88. The conductive rail member 360 is electrically connected to the ground screw 314 in any suitable manner as indicated schematically at 362. The conductive rail member 360 is made from a non-corroding electrically conductive material, preferably aluminum in the form of a foil, tape, or the like. The conductive rail member 360 may also be a conductive plastic strip. The conductive rail member 360 is preferably co-extruded with the mounting rail 350. The conductive member 360 may alternatively be secured to the mounting rail 350 by an adhesive or in another known manner.

When a door such as the door 16 having thereon a safety edge assembly 340 is closing, and the safety edge assembly 340 is not in contact with an obstruction, the safety edge assembly 340 is in an unactuated condition. In the unactuated condition, the electrically conductive member 160 on the tubular member 100 is spaced apart from the conductive rail member 360 on the non-conductive mounting rail 350. There is no electric contact or electric circuit between the electrically conductive member 160 and the conductive rail member 360 on the mounting rail 350.

Should the safety edge assembly 340 contact an obstruction while the door 16 is closing, the safety edge assembly 340 is actuated as illustrated in FIG. 9. The tubular member 100 deforms upwardly. Upward movement of the tubular member 100 effects upward movement of the electrically conductive member 160 toward the electrically conductive rail member 360. The electrically conductive member 160 engages the electrically conductive rail member 360.

The engagement of the electrically conductive member 160 with the electrically conductive rail member 360 establishes electrical contact and completes an electrical circuit between the positive wire 302 and the ground wire 304 in a manner as described above. The completion of the electric circuit actuates the operator 32 to reverse the direction of travel of the door 16.

FIGS. 10–13 illustrate some possible different configurations of the tubular member 100. All other elements of the safety edge assemblies shown in FIGS. 10–13 are the same. The tubular members shown in FIGS. 10–13 include additional arcuate walls defining one or more additional layers of tubular chambers. The different configurations illustrated can produce an increased air shock effect and a softer impact of the door 16 with an obstruction, and can provide an increased sealing effect against the floor 28.

Figure 10:
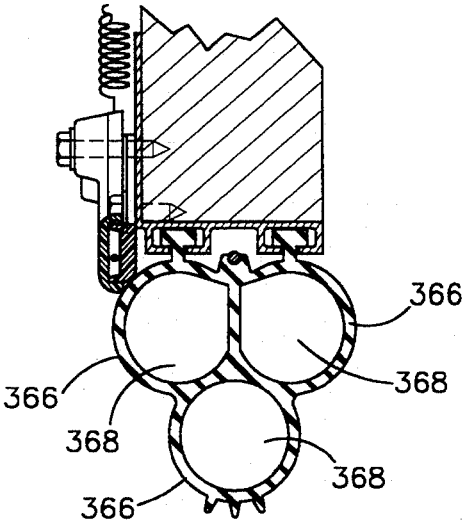
FIG. 10 illustrates a safety edge assembly similar to the safety edge assembly of FIG. 2 and having a deformable tubular member of a different configuration.
Figure 11:
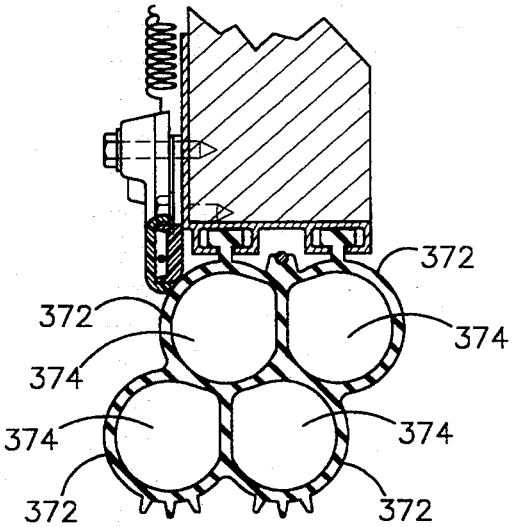
FIG. 11 is a view similar to FIG. 10 and showing a deformable tubular member of a second, different configuration.
Figure 12:
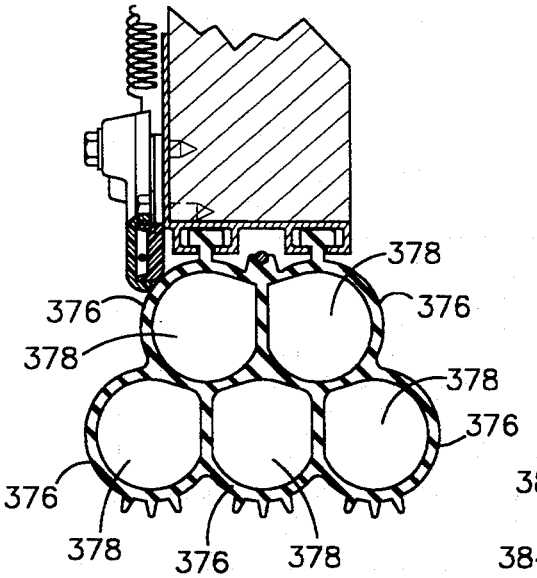
FIG. 12 is a view similar to FIG. 10 and showing a deformable tubular member of a third, different configuration.
Figure 13:
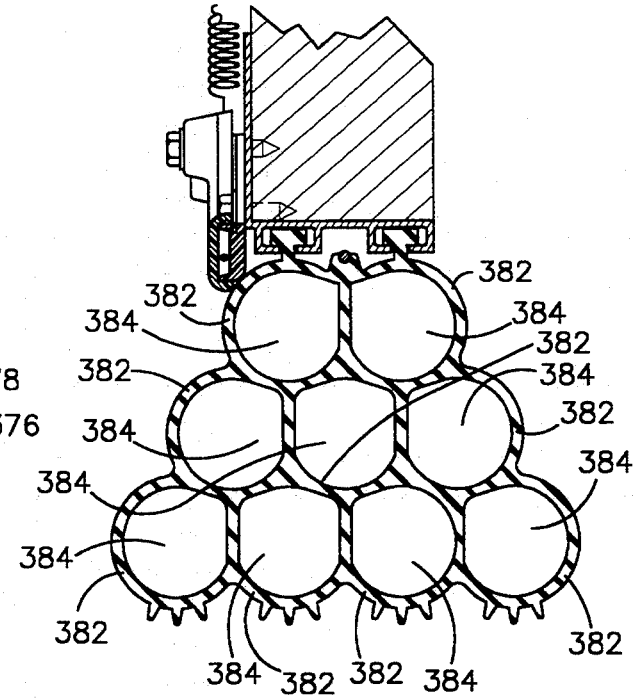
FIG. 13 is a view similar to FIG. 10 and showing a deformable tubular member of a fourth, different configuration.

Specifically, FIG. 10 illustrates a tubular member having three arcuate walls 366 defining three tubular chambers 368. FIG. 11 illustrates a tubular member having four arcuate walls 372 defining four tubular chambers 374. FIG. 12 illustrates a tubular member having five arcuate walls 376 defining five tubular chambers 378. FIG. 13 illustrates a tubular member having nine arcuate walls 382 defining nine tubular chambers 384.

A safety edge assembly 10 in accordance with the present invention may upon installation need to be shortened by cutting to fit a door of a certain length. The installer first makes the mounting rail 40 or 350 a desired length corresponding to the length of the door 16, preferably by cutting the one end of the mounting rail at which the electrical connections will not be made. The mounting rail is then secured to the door 16. The installer then makes the tubular member 100 and its attached electrically conductive member 160 the desired length, preferably by cutting the same end of the tubular member 100 as was cut on the mounting rail 40. The installer mounts the tubular member 100 on the mounting rail 40 by sliding the T-shaped support members 132 and 134 into the support channels 78 and 86 of the mounting rail.

The installer inserts the end plug 320 which includes the tab 340 and retainer button 338 into the cut end of the tubular member 100. The retainer button 338 on the tab 340 snaps into the left retainer opening 336 (FIG. 4) on the horizontally extending rail portion to secure the end plug 320 in position. If the end of the electrically conductive member 160 has been cut, it may fray or be loosened from its otherwise secure connection with the tubular member. The tab 340 extends into the central channel 88, insulating the end of the electrically conductive member 160 from the mounting rail 40. The tab 340 on the end plug can serve the same purpose to block inadvertent electrical contact between a loose end of the member 160 and the mounting rail 40. Thus, even though the electrically conductive member is normally very closely spaced (about 4 mm or one-sixth of an inch) from the conductive mounting rail, there is no chance of inadvertent contact between the conductive member and the mounting rail.

The present invention is advantageous in several other regards. The electrically conductive member 160, which is a strong wire or cable, is physically locked into the tubular member 100. However, it can be easily inspected and repaired or replaced if necessary, by removing the tubular member 100 from the mounting rail 40. Only a light pull-out force is then needed to remove the member 160 from the tubular member 100.

The central chamber 88 is shielded by the tubular member 100 and the mounting rail 40 and the end plugs. The location of the electrically conductive member 160 on the top of the tubular member 100 in close proximity to the conductive mounting rail 40, keeps elements such as snow and rain away from the area of electrical contact between the conductive member and the mounting rail. This location of the area of electrical contact is also spaced away from the floor 28.

Because the tubular member 100 is easily deformable, electric contact is made within the first one-third of deformation of the tubular member. Almost the entire balance of the amount of deformation of the tubular member 100 is accomplished without a substantial increase in force applied to the tubular member. This enables the safety edge assembly 10 to react rapidly to an encounter with an obstruction, and to keep the impact force low.

The double-chambered configuration of the tubular member 100 is advantageous in several ways. Should one of the chambers 118 and 128 become unsealed, as by tearing of the material of the tubular member 100, the other chamber can remain sealed. This can ensure that the tubular member 100 will continue to seal against the floor 28, and that the air pressure sensing mechanism will continue to function. The wide, flat configuration of the tubular member 100 also provides a larger footprint to reduce the pressure applied to human body parts accidentally in the path of the closing door.

The double-chambered configuration of the tubular member 100, with its central wall 102, also aids in ensuring the desired contact between the conductive member 160 and the conductive mounting rail 40, even when force is applied to the tubular member 100 in an upward direction but as much as 45° from the vertical. The conductive member 160 is disposed on the open fourth side of the generally rectangular central channel 88. Any movement of the central wall 102 upon deformation of the tubular member 100 acts to force the upper portion 136 to move always in a direction into the central channel 88. This ensures engagement and electrical contact between the conductive member 160 and the mounting rail 40. The tubular member 100 is also self-centering after deformation.

The use of a rigid or relatively rigid mounting rail as one of the electrical contacts of the safety edge assembly 10 is also advantageous. The mounting rail is preferably an aluminum or hard plastic extrusion. Such a piece is strong and stable and easy to mount to the door without misalignment, as compared to a deformable seal member. The mounting rail stays straight to ensure uniform electrical contact over the entire extent of the safety edge assembly for the life of the product.

From the above description of the invention, those skilled in the art will perceive improvements, changes and modifications in the invention. Such improvements, changes and modifications within the skill of the art are intended to be covered by the appended claims.

We claim:

1. A safety edge assembly for mounting on a leading edge portion of a movable closure such as an overhead garage door, the door being movable by an electrically controlled operator in a first direction to close the door and in a second direction opposite to the first direction to open the door, said safety edge assembly comprising:

an electrically conductive rigid mounting rail for connection with the door;

a deformable member supported on said mounting rail, said deformable member having a tubular wall defining a tubular chamber in said deformable member, said tubular wall having at least one inner surface defining said chamber and having an exposed outer surface; and a conductive member disposed on said exposed outer surface of said deformable member, said conductive member being movable, upon deformation of said deformable member, from a first position normally spaced from said conductive mounting rail into a second position in engagement with said conductive mounting rail to complete an electrical circuit for controlling the direction of movement of the door.

2. A safety edge assembly as set forth in claim 1 wherein said electrically conductive mounting rail comprises a rigid non-corroding electrically conductive member having a first major side surface and having a second major side surface which extends transverse to said first major side surface, said first major side surface of said mounting rail being in abutting engagement with a first major side surface of said door and said second major side surface of said mounting rail being in abutting engagement with a second major side surface of said door, and said conductive member comprises a flexible non-corroding metal wire.

3. A safety edge assembly as set forth in claim 1 for mounting on a leading edge portion of the door having a side surface and a leading edge surface, wherein said mounting rail has a first portion in abutting engagement with the side surface of the door and a second portion in abutting engagement with the leading edge surface of the door, said second portion of said mounting rail comprising means for supporting said tubular member on said mounting rail and thereby on said door.

4. A safety edge assembly as set forth in claim 3 wherein said means for supporting said deformable member includes a plurality of channel portions defining first and second support channels of said mounting rail, said deformable member having a first supporting member slidably received in the first support channel and a second supporting member slidably received in the second support channel, said first and second supporting members supporting said conductive member in its first position normally spaced from said conductive mounting rail, said channel portions of said mounting rail having a plurality of interconnected electrically conductive surfaces extending transverse to each other and at least partially defining a generally U-shaped central channel of said rigid mounting rail, each one of said electrically conductive surfaces being engageable by said deformable member upon movement of said deformable member in a selected one of a plurality of different directions, said plurality of different directions including said first direction of movement of said door and also including directions substantially transverse to said first direction.

5. A safety edge assembly for mounting on a leading edge of a door such as an overhead garage door, the door being movable by an electrically controlled operator in a first direction to close the door and being movable by the operator in a second direction opposite to the first direction to open the door, said safety edge assembly comprising:

a tubular member having an open end and having a conductive element, a conductive mounting rail on which said tubular member is supported, and an end plug for closing the open end of said tubular member, said end plug having a nonconductive portion disposed between said conductive element on the tubular member and the conductive mounting rail to provide electrical insulation therebetween.

6. A safety edge assembly as set forth in claim 5 wherein said conductive mounting rail has portions at least partially defining a channel of said mounting rail, said electrically conductive member being normally spaced apart from said mounting rail across the channel, said non-conductive portion of said end plug comprising a portion of said end plug extending axially from said end plug into the channel intermediate an end portion of said electrically conductive member and an end portion of said mounting rail.

7. A method of mounting a safety edge assembly on a leading edge of a door such as an overhead garage door, the door being movable by an electrically controlled operator in a first direction to close the door and being movable by the operator in a second direction opposite to the first direction to open the door, the door having a length, said method comprising the steps of:

providing a conductive mounting rail;

making the conductive mounting rail a desired length corresponding to the length of the door;

attaching the conductive mounting rail to the leading edge of the door;

providing a tubular member having a conductive portion;

making the tubular member and its conductive portion a desired length corresponding to the length of the door;

mounting the tubular member on the conductive mounting rail with the conductive portion of the tubular member spaced apart from the conductive mounting rail;

providing an end plug for the tubular member; and inserting an electrically insulating portion of the end plug between the conductive rail and the conductive portion of the tubular member to provide electrical insulation therebetween.

8. A method as set forth in claim 7 wherein said step of making the conductive mounting rail a desired length includes cutting the conductive mounting rail to a desired length.

9. A method as set forth in claim 7 wherein said step of providing an end plug for the tubular member includes providing an end plug having a projecting retainer member thereon;

said step of providing a conductive mounting rail includes providing a conductive mounting rail having a retainer opening therein; and said step of inserting the electrically insulating portion of the end plug between the conductive rail and the conductive portion of the tubular member comprises the step of inserting the retainer member of the end plug into the retainer opening of the mounting rail to block movement of the end plug relative to the tubular member and to the mounting rail.

10. A safety edge assembly for mounting on a leading edge portion of a door such as an overhead garage door, said door being movable by an electrically controlled operator in a first direction to close the door and in a second direction opposite to the first direction to open the door, said safety edge assembly comprising:

a non-conductive mounting rail for connection with the door;

an electrically conductive rail member connected with said non-conductive rail;

a deformable member supported on said non-conductive mounting rail, said deformable member having a tubular wall defining a tubular chamber in said deformable member, said tubular wall having at least one inner surface defining said chamber and having an exposed outer surface; and a conductive member disposed on said exposed outer surface of said deformable member, said conductive member being movable, upon deformation of said tubular member by contact with an obstruction, from a first position normally spaced from said conductive rail member into a second position in engagement with said conductive rail member to complete an electrical circuit for controlling the direction of movement of the door.

11. A safety edge assembly as set forth in claim 10 wherein said non-conductive mounting rail comprises a rigid plastic extrusion having a first major side surface and having a second major side surface which extends transverse to said first major side surface, said first major side surface of said mounting rail being in abutting engagement with a first major side surface of said door and said second major side surface of said mounting rail being in abutting engagement with a second major side surface of said door, and said conductive rail member comprises a flexible electrically conductive strip co-extruded with said plastic extrusion.

12. A safety edge assembly for mounting on a leading edge portion of a door such as an overhead garage door, the door being movable by an electrically controlled operator in a first direction to close the door and in a second direction opposite to the first direction to open the door, said safety edge assembly comprising:

an electrically conductive mounting rail for connection with the door;

a deformable tubular member supported on said mounting rail; and a conductive member on said tubular member, said conductive member being movable, upon deformation of said tubular member, from a first position normally spaced from said conductive mounting rail into a second position in engagement with said conductive mounting rail to complete an electrical circuit for controlling the direction of movement of the door;

said electrically conductive mounting rail comprising a relatively rigid member made from a non-corroding metal and said conductive member comprising a relatively flexible non-corroding metal wire;

said mounting rail comprising means for supporting said tubular member on said mounting rail and thereby on said door;

said second portion of said mounting rail including surfaces defining an open channel of said mounting rail, said electrically conductive member being disposed adjacent the open channel of said mounting rail;

said electrically conductive member being movable, as a result of forces applied to said tubular member upon contact between said tubular member and an obstruction, into the open channel to engage said conductive mounting rail to actuate the operator and reverse the direction of travel of the door.

13. A safety edge assembly for mounting on a leading edge portion of a movable closure such as an overhead garage door, the door being movable by an electrically controlled operator in a first direction to close the door and in a second direction opposite to the first direction to open the door, said safety edge assembly comprising:

an electrically conductive mounting rail for connection with the door;

a deformable member supported on said mounting rail; and a conductive member on said deformable member, said conductive member being movable, upon deformation of said deformable member, from a first position normally spaced from said conductive mounting rail into a second position in engagement with said conductive mounting rail to complete an electrical circuit for controlling the direction of movement of the door;

wherein said mounting rail includes a first surface, a second surface, and a third surface, said first, second and third surfaces of said mounting rail forming three sides of a four-sided channel of said mounting rail, the fourth side of the channel being open;

said electrically conductive member being disposed along the open fourth side of the channel of the mounting rail;

said electrically conductive member being movable, as a result of forces applied to said deformable member upon contact between said deformable member and an obstruction, into the four-sided channel and into engagement with said conductive mounting rail to actuate the operator and reverse the direction of travel of the door;

said electrically conductive member being movable, as a result of differently directed forces applied to said deformable member upon contact between said deformable member and an obstruction, in a first direction to engage said first surface of said mounting rail and in a second direction to engage said second surface of said mounting rail and in a third direction to engage said third surface of said mounting rail.

14. A safety edge assembly as set forth in claim 13 wherein said deformable member is a tubular member including wall portions defining first and second chambers in said tubular member extending parallel to each other for substantially the entire length of said safety edge assembly, said wall portions including a central wall separating said first chamber from said second chamber, said conductive member being disposed in an upper channel of said tubular member at a location between said tubular member central wall and said conductive mounting rail.

15. A safety edge assembly for mounting on a leading edge portion of a movable closure such as an overhead garage door, the door being movable by an electrically controlled operator in a first direction to close the door and in a second direction opposite to the first direction to open the door, said safety edge assembly comprising:

an electrically conductive mounting rail for connection with the door;

a deformable member supported on said mounting rail; and a conductive member on said deformable member, said conductive member being movable, upon deformation of said deformable member, from a first position normally spaced from said conductive mounting rail into a second position in engagement with said conductive mounting rail to complete an electrical circuit for controlling the direction of movement of the door;

wherein said deformable member is a tubular member and further including an end plug closing an end of said tubular member, said end plug having a non-conductive portion disposed between an end portion of said conductive member and an end portion of said electrically conductive mounting rail to provide electrical insulation therebetween.

16. A safety edge assembly for mounting on a leading edge portion of a door such as an overhead garage door, the door being movable by an electrically controlled operator in a first direction to close the door and in a second direction opposite the first direction to open the door, said safety edge assembly comprising:

an electrically conductive mounting rail for connection with the door;

a deformable tubular member supported on said mounting rail; and an end plug closing an end of said tubular member, said end plug including means for sensing pressure changes in said tubular member to control actuation of said electrically controlled operator, said end plug also including means for establishing an electrical connection between said electrically controlled operator and said electrically conductive mounting rail;

wherein said tubular member includes axially extending wall portions defining first and second axially extending chambers in said tubular member;

said end plug having surfaces defining an air pressure passage extending between the chambers of said tubular member and an external surface of said end plug;

said safety edge assembly including pressure sensing means for sensing pressure changes in the air pressure passage and thereby sensing pressure in the chambers of said tubular member to control actuation of the electrically controlled operator.

17. A safety edge assembly for mounting on a leading edge portion of a movable closure such as an overhead garage door, the door being movable by an electrically controlled operator in a first direction to close the door and in a second direction opposite to the first direction to open the door, said safety edge assembly comprising:

an electrically conductive rigid mounting rail for connection with the leading edge portion of the door;

a deformable member supported on said mounting rail, said deformable member having a tubular wall defining a tubular chamber in said deformable member, said tubular wall having at least one inner surface defining said chamber and having an exposed outer surface facing in said second direction;

said deformable member being supported on said mounting rail at a location spaced apart from the door with said mounting rail disposed intermediate the door and said deformable member; and an electrically conductive wire member disposed on said exposed outer surface of said deformable member at a location facing in said second direction;

said mounting rail having an electrically conductive surface which faces in said first direction and which is presented toward said wire member;

said wire member having a first position normally spaced from said electrically conductive surface on said mounting rail and a second position in engagement with said electrically conductive surface on said mounting rail said wire member being movable in said second direction, upon deformation of said deformable member, from said first position to said second position to complete an electrical circuit for controlling the direction of movement of the door.

18. A safety edge assembly as set forth in claim 17 wherein said mounting rail has a first major side surface and a second major side surface extending transverse to said first major side surface, said first major side surface of said mounting rail being in abutting engagement with a first major side surface of said door and said second major side surface of said mounting rail being in abutting engagement with a second major side surface of said door, and wherein said wire member comprises a flexible non-corroding metal wire.

19. A safety edge assembly as set forth in claim 18 wherein said mounting rail includes a plurality of interconnected electrically conductive surfaces extending transverse to each other and at least partially defining a generally U-shaped central channel of said mounting rail, each one of said electrically conductive surfaces being engageable by said wire member upon movement of said deformable member in a selected one of a plurality of different directions, said plurality of different directions including said first direction of movement of said door and also including directions substantially transverse to said first direction.

* * * * *